US005649644A

United States Patent [19]

Hashimoto et al.

[11] Patent Number: 5,649,644

[45] Date of Patent: Jul. 22, 1997

[54] MIXING TYPE DRINK DISTRIBUTOR

[75] Inventors: Masami Hashimoto; Manabu Tachibana, both of Mie, Japan

[73] Assignee: Fuji Electric Co., Ltd., Kawasaki, Japan

[21] Appl. No.: 402,171

[22] Filed: Mar. 13, 1995

[30] Foreign Application Priority Data

Mar. 18, 1994 [JP] Japan ..... 6-048043
Dec. 16, 1994 [JP] Japan ..... 6-312897

[51] Int. Cl.[6] ..... B05B 7/24

[52] U.S. Cl. ..... 222/129.1; 239/423; 239/428

[58] Field of Search ..... 222/129.1; 239/425, 239/424.5, 428.5, 423, 428

[56] References Cited

U.S. PATENT DOCUMENTS

| | | | |
|---|---|---|---|
| 597,842 | 1/1898 | Edwards | 239/590.5 X |
| 2,275,691 | 3/1942 | Simanton | 239/425 |
| 2,921,605 | 1/1960 | Booth et al. . | |
| 3,245,622 | 4/1966 | McBride | 239/425 |
| 3,349,968 | 10/1967 | Yuza | 222/132 |
| 3,758,037 | 9/1973 | Marion et al. | 239/425 X |
| 4,708,266 | 11/1987 | Rudick | 222/105 |
| 4,932,564 | 6/1990 | Austin et al. . | |
| 4,986,497 | 1/1991 | McCowan et al. | 222/129.1 X |

FOREIGN PATENT DOCUMENTS

| | | | |
|---|---|---|---|
| 37 09 161 | 10/1987 | Germany . | |
| 547876 | 9/1956 | Italy | 239/428.5 |
| 792911 | 4/1958 | United Kingdom . | |
| WO90/11961 | 10/1990 | WIPO . | |
| WO91/17948 | 11/1991 | WIPO . | |

*Primary Examiner*—Kevin Weldon
*Attorney, Agent, or Firm*—Kanesaka & Takeuchi

[57] ABSTRACT

A mixing type drink distributor is formed of a head having a plurality of jet pipes for supplying different concentrated liquids and a supply port for supplying a diluent liquid to dilute the concentrated liquids, and a nozzle installed around the outer circumference of the head. The nozzle includes a mixing section for mixing one of the concentrated liquids with the diluent liquid, and an opening section situated under the mixing section for ejecting the mixture in the mixing section downwardly. Jet nozzles are fixed to the jet pipes to protrude from the lower face of the head so that the concentrated liquids are ejected through the respective jet nozzles without contacting the head.

9 Claims, 4 Drawing Sheets

MIXING TYPE DRINK DISTRIBUTOR

BACKGROUND OF THE INVENTION AND RELATED ART STATEMENT

The present invention relates to a mixing type drink distributor for mixing one of concentrated liquids of different flavors with a diluent liquid, such as carbonated water and cold water, and ejecting the mixture.

FIG. 10 shows a conventional mixing type drink distributor, and FIG. 11 is a section view taken along a line 11—11 of FIG. 10. In these figures, a nozzle 2 is installed around a head 1 through an O-rings 3.

The head 1 has four jet pipes 4 to separately supply, for example, concentrated liquids with four different flavors, and the lower ends of the jet pipes 4 are opened in the lower face 10 of the head as jet ports 8 for the concentrated liquids.

The jet pipes 4 are located on the circumference of a circle as viewed from the top of the head 1. A diluent liquid passage 7 is disposed in the center of the head 1, and radially branches in the form of T to communicate with the inner face of the nozzle 2.

Over the upper face of the head, the jet pipes 4 are connected to retention containers (not shown) for respective concentrated liquids with different flavors via solenoid valves 18.

The diluent liquid passage 7 is connected to branch pipes of diluent liquids, such as carbonated water and cold water, each of which is connected to a diluent liquid container (not shown) via a solenoid valve 19.

In this structure, one of the concentrated liquids selected according to an instruction from a different mechanism (not shown) gushes out from one of the jet ports 8 into the mixing section 9 of the nozzle 2 via a solenoid valve associated with that concentrated liquid, while a selected diluent liquid flows through the diluent liquid passage 7 via a solenoid valve associated with that diluent liquid and gushes against the internal wall of the nozzle 2. The diluent liquid then flows down through a gap between the internal wall and the head 1 into the mixing section 9 of the nozzle 2.

The concentrated liquid and the diluent liquid that have been selected and jetted out are mixed in the mixing section 9 of the nozzle 2, and then ejected through an opening 13 in the bottom of the nozzle 2.

Reference number 24 designates a carbonator which is supplied with water and a carbon-dioxide gas from water and carbon-dioxide supply ports (not shown) for mixing in order to generate carbonated water.

In the conventional mixing type drink distributor, since various combinations are selected from a plurality of concentrated liquids and a plurality of diluent liquids for mixing, a part of a selected concentrated liquid may adhere to the bottom of the head due to surface tension and remains there after the mixture has ejected. Such a residual concentrated liquid may be mixed into a subsequently selected concentrated liquid.

In addition, a part of a selected diluent liquid may remain in the diluent liquid passage after the liquid has been mixed with a concentrated liquid and ejected, and may flow onto the lower face of the head and adhere thereto due to surface tension. Such a diluent liquid may also be mixed into a subsequently selected diluent liquid.

If a subsequently selected concentrated liquid and a diluent liquid differ from the previously selected concentrated liquid and the diluent liquid, the mixture of the subsequently selected concentrated liquid and diluent liquid may include the residue of the previously selected concentrated liquid and diluent liquid, resulting in degradation of flavor of the subsequent mixture.

It is thus an object of the invention to provide a mixing type drink distributor that prevents a previously selected concentrated liquid or diluent liquid from mixing into a subsequently selected concentrated liquid or diluent liquid.

SUMMARY OF THE INVENTION

In a first aspect of the invention, a mixing type drink distributor comprises a head having a plurality of jet pipes for supplying various types of concentrated liquids with different flavors and a supply port for a diluent liquid to dilute the concentrated liquids, and a nozzle installed on the outer circumference of the head and having a mixing section for mixing one of the concentrated liquids with the diluent liquid and an opening for ejecting the mixture downward, wherein jet ports for the jet pipes protrude from the head so that the jet ports can be used as jet nozzles for the respective concentrated liquids.

In a second aspect of the invention, the mixing type drink distributor is formed according to the first aspect, wherein the tip face of the jet nozzle for the concentrated liquid is inclined and the lower part of the inclined tip face is located closer to the center of the head.

In a third aspect of the invention, the mixing type drink distributor is formed according to the first or second aspect, wherein the jet nozzles for the concentrated liquids are located on the circumference of a circle, and the diameter of a circle circumscribing the nozzle tip pores is smaller than the inner diameter of the opening in the lower section of the nozzle installed around the head.

In a fourth aspect of the invention, a mixing type drink distributor comprises a head having a plurality of jet pipes for supplying concentrated liquids with different flavors and a supply port of a diluent liquid to dilute the concentrated liquids, and a nozzle installed on the outer circumference of the head and having a mixing section for mixing the concentrated liquid with the diluent liquid and an opening section for ejecting the mixed liquid downwardly, wherein the head has on the lower outer circumference a rib protruding downwardly.

In a fifth aspect of the invention, a mixing type drink distributor comprises a head having a plurality of jet pipes for supplying concentrated liquids with different flavors and a supply port of a diluent liquid to dilute the concentrated liquids, and a nozzle installed on the outer circumference of the head and having a mixing section for mixing the concentrated liquid with the diluent liquid and an opening section for ejecting the mixture downwardly, wherein the head has a plurality of protruding side ribs. Each side rib extends from a portion where the flown-out diluent liquid changes its direction along the side of the head to a middle of the side of the head directing downwardly.

In a sixth aspect of the invention, a mixing type drink distributor comprises a head having a plurality of jet pipes for supplying concentrated liquids with different flavors and a supply port of a diluent liquid to dilute the concentrated liquids, and a nozzle installed on the outer circumference of the head and having a mixing section for mixing the concentrated liquid with the diluent liquid and an opening for ejecting the mixture downwardly, wherein a passage to supply the diluent liquid is connected to a carbon-dioxide passage via a check valve.

In a seventh aspect of the invention, the mixing type drink distributor is formed according to the sixth aspect, wherein a safety valve is connected to the carbon-dioxide passage.

In the invention, since the respective nozzles for different concentrated liquids protrude from the lower face of the head and the tip faces of the nozzles are inclined, almost all the remaining concentrated liquids adhering to the nozzle tip faces drop off before a different concentrated liquid is subsequently selected.

Furthermore, the protruding rib installed on the lower face of the head prevents the remaining diluent liquid from flowing beneath the lower face.

Still further, since the diluent liquid passage is supplied with a carbon dioxide gas after each drink is served and the gas blows the remaining liquid away, liquid does not remain in the diluent liquid passage and the nozzle.

DETAILED DESCRIPTION OF PREFERRED EMBODIMENTS

Figure 1:
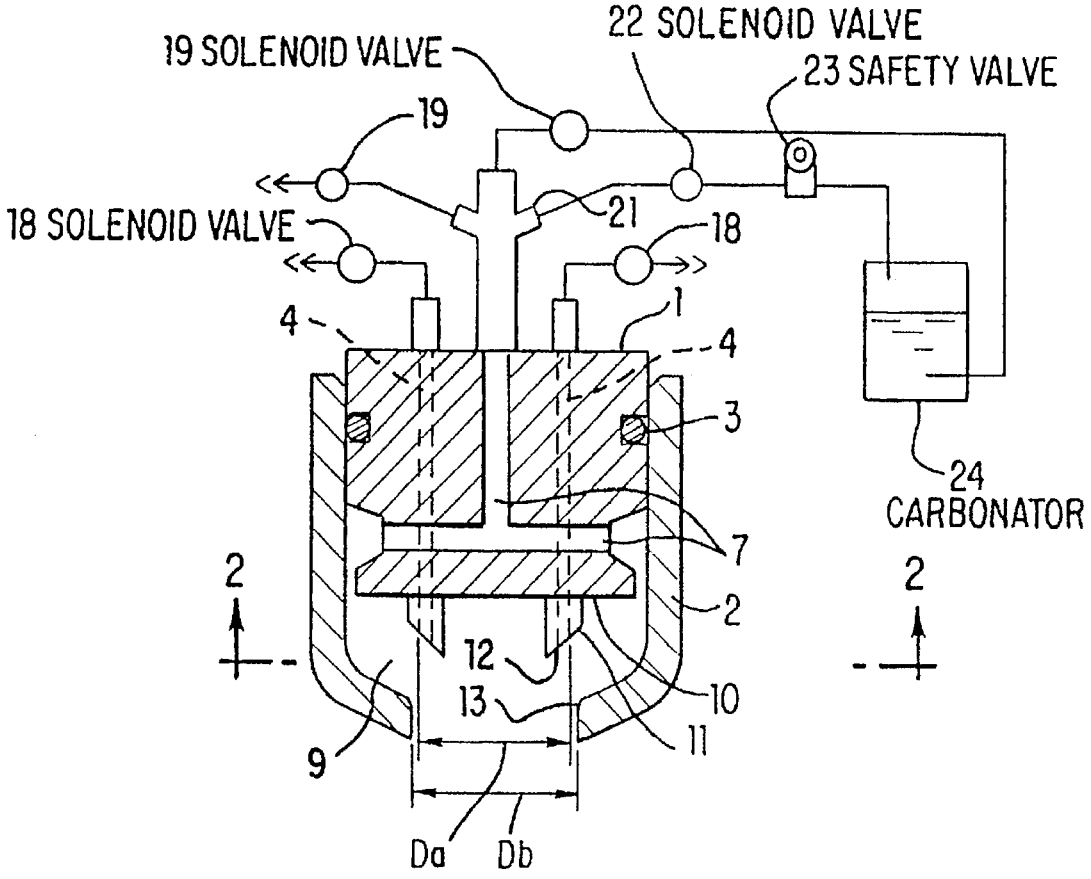
FIG. 1 is a cross section view of a first embodiment of the invention; f
Figure 2:
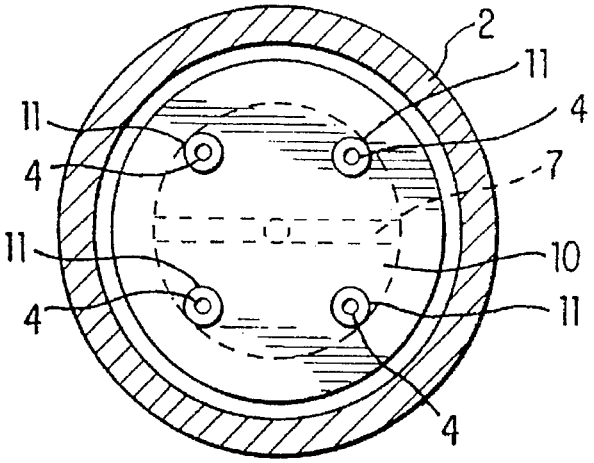
FIG. 2 is a section view taken along a line 2—2 of FIG. 1.
Figure 10:
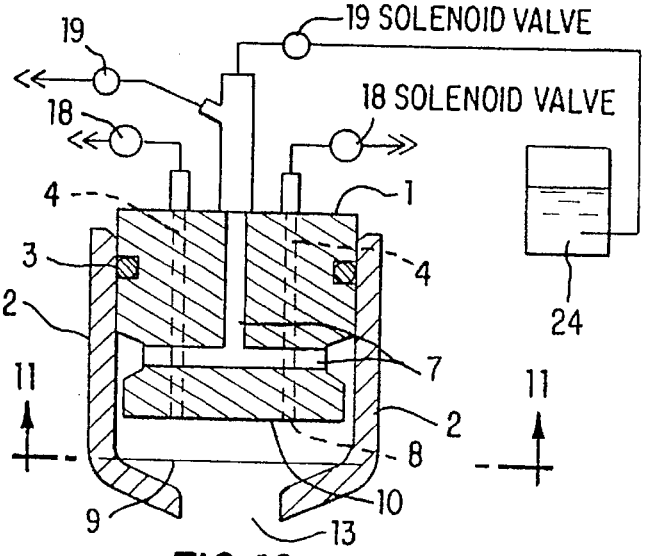
FIG. 10 PRIOR ART
FIG. 10 is a cross section view of an example of the prior art.
Figure 11:
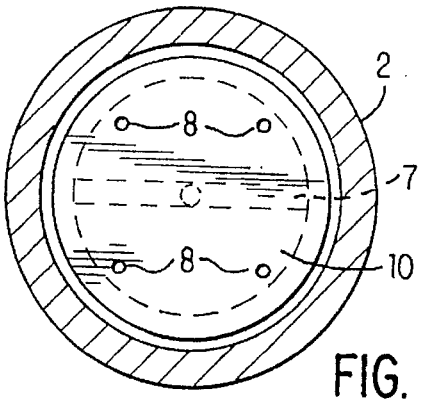
FIG. 11 PRIOR ART
FIG. 11 is a section view taken along a line 11—11 of FIG. 10.

FIG. 1 is a cross section view of a first embodiment of the invention, and FIG. 2 is section view taken along a line 2—2 in FIG. 1. In the embodiments, the members with the same reference numbers as in FIGS. 10 and 11 which show a conventional mixing type drink distributor have substantially the same functions as the corresponding members in FIGS. 10 and 11.

In FIG. 1, a head 1 has jet pipes 4 for respective concentrated liquids located on the circumference of a circle as viewed from the top of the head, nozzles 11 having inclined tip faces and protruding from the head lower face 10, a diluent liquid passage 7, and a nozzle 2 which is installed around the head via an O-ring 3. The nozzle 2 has a mixing section 9 and an opening 13 in the lower part.

The diameter Da of the circumscribing circle of the tip pores of the nozzles 11 is somewhat smaller than the diameter Db of the opening in the lower part of the nozzle 2 installed around the head with the O-ring 3.

Over the upper face of the head 1, the jet pipes 4 are connected to respective retention containers (not shown) for the concentrated liquids with different flavors via solenoid valves 18.

The diluent liquid passage 7 is connected to branch pipes for diluent liquids, such as carbonated water and cold water, each of which is connected to a diluent liquid container (not shown) via a solenoid valve 19.

A carbon-dioxide passage 21 is formed as one of the branch pipes and connected to a carbonator 24 via a solenoid valve 22 and a safety valve 23. After each drink is served, the diluent liquid passage is supplied with a carbon dioxide gas from the carbonator 24 via the safety valve 23 and the solenoid valve 22 to blow away the residual liquid in the passage.

The first embodiment is actuated as in the conventional distributor. Namely, when the distributor is actuated, a selected concentrated liquid is supplied from one of the nozzles 11, and also a selected diluent liquid is supplied through the passage 7. The concentrated liquid and the diluent liquid are mixed at the mixing section 9, and ejected through the opening 13.

In the first embodiment of the invention, after each drink is served, the carbon dioxide gas is supplied through the passage 7. Thus, the liquid remaining in and around the nozzle 2 and the head 1 is substantially blown off. Also, since the diameter Da for the nozzles 11 is smaller than the diameter Db of the opening 13 in the nozzle 2, even if the liquid drips from or through the nozzles 11 after the gas blowing, liquid can drop through the opening 13 without contacting the nozzle 2. Further, since the nozzles 11 project downwardly, the liquids from the nozzles 11 do not adhere to the bottom face of the head. Thus, the liquid does not substantially remain in and around the nozzle 2 at the opening 13.

Figure 3:
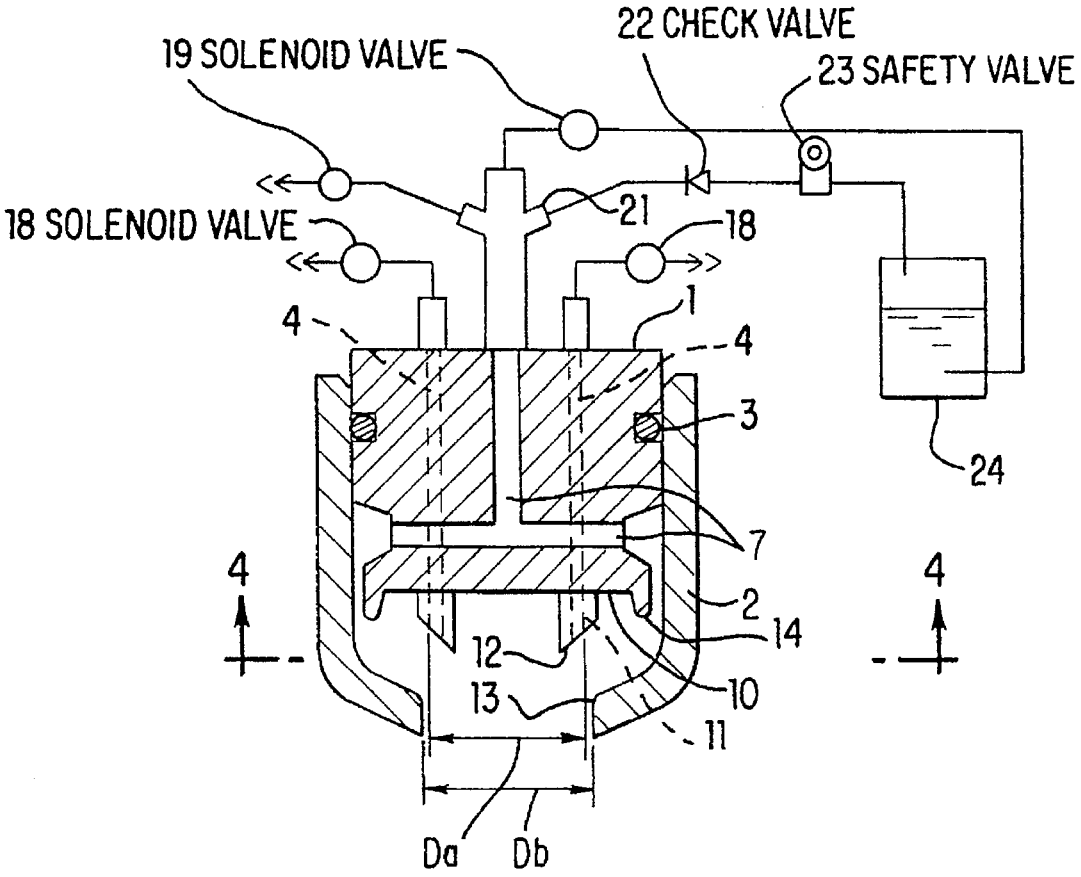
FIG. 3 is a cross section view of a second embodiment of the invention.
Figure 4:
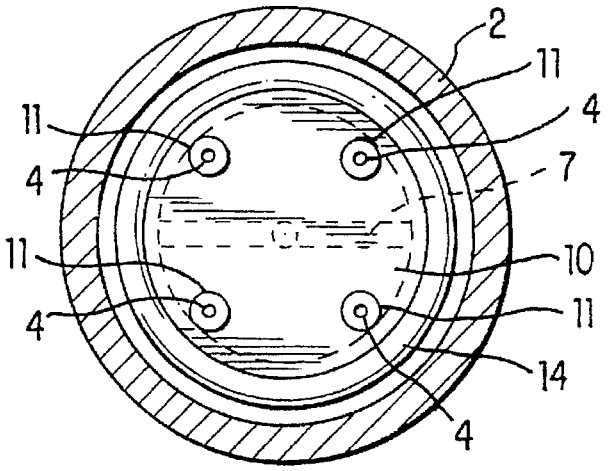
FIG. 4 is a section view taken along a line 4—4 of FIG. 3.

FIG. 3 is a cross section of a second embodiment of the invention, and FIG. 4 is a section view taken along a line 4—4 in FIG. 3. FIGS. 3 and 4 differ from FIGS. 1 and 2 in that the head has on the lower outer circumference a rib 14 protruding downwardly.

Figure 5:
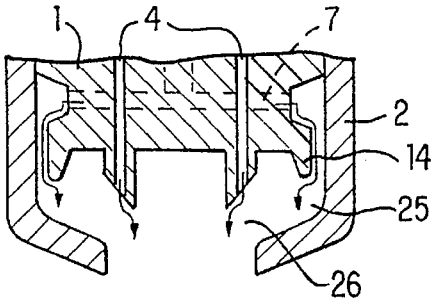
FIG. 5 illustrates dripping of residual concentrated liquids and diluent liquid according to the invention.

The rib 14 protruding downward from the lower face of the head prevents the dripping of the residual diluent liquid from flowing onto or beneath the lower face of the head and adhering thereto. FIG. 5 shows the flows of the dripping of the residual concentrated liquid 26 and residual diluent liquid 25. Thus, the diluent liquid as well as the concentrated liquid do not substantially adhere to the lower surface of the head. Also, when the carbon dioxide gas is supplied, the gas can blow off the liquid in the head.

Figure 6:
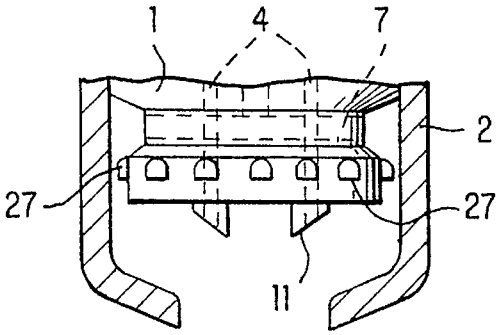
FIG. 6 is a cross section view of a third embodiment of the invention.

FIG. 6 is a cross section view of a third embodiment of the invention. FIG. 6 differs from FIG. 1 in that the head has a plurality of protruding side ribs 27. Each rib extends from a portion where the flown-out diluent liquid changes its direction onto the side of the head to the middle of the side, not to the bottom of the head.

When a diluent liquid flows toward the mixing section 9 of the nozzle 2, these side ribs 27 divide the flow of the diluent liquid at the top in such a way that the liquid uniformly flows between the adjacent side ribs 27 along the side of the head 1. A part of the liquid swirls near the lower end of each of the side ribs 27, which then flows underneath the ribs 27. The adjacent flows meet one another after the ribs 27 and as a result, the diluent liquid flows down along the entire side surface of the head. Without the side ribs 27, if there is a rift or gap in the diluent liquid flowing along the side of the head 1, the rift may be extended by surface tension to bias the flow of the diluent liquid toward a certain area of the side of the head. The side ribs 27 prevent such a rift in the flow.

Furthermore, since the length of the side ribs 27 is limited to the middle of the side of the head 1, the diluent liquid flows underneath the side ribs 27 along the head 1, so that the flow is not divided again. Thus, the concentrated liquid and the diluent liquid are well mixed together.

Figure 7:
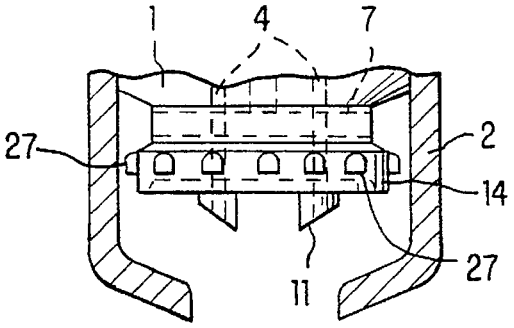
FIG. 7 is a cross section view of a fourth embodiment of the invention.

FIG. 7 is a cross section view of a fourth embodiment of the invention. FIG. 7 differs from FIG. 6 in that the head 1 has on the lower outer circumference a rib 14 protruding downwardly. The rib 14 operates as explained in FIG. 3.

Figure 8:
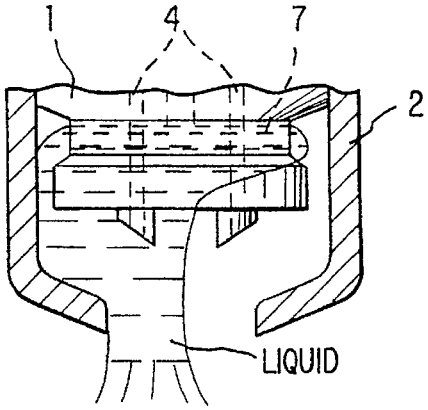
FIG. 8 is a diagram for showing that the flow of diluent liquid is biased due to the absence of side ribs.
Figure 9:
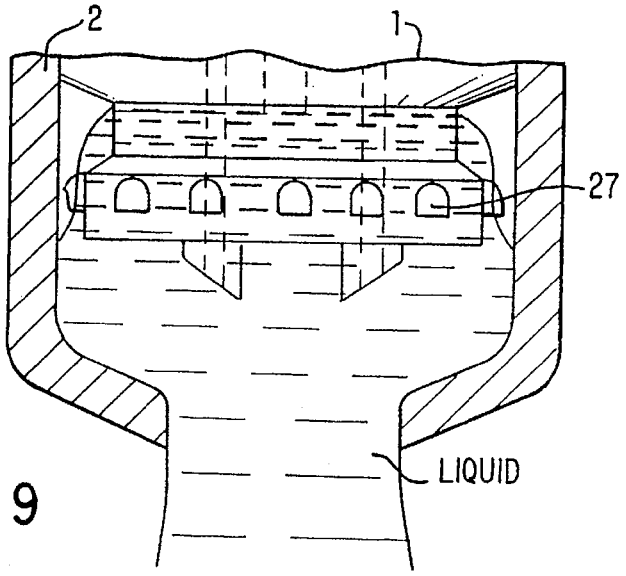
FIG. 9 is a diagram for showing that side ribs allow the diluent liquid to flow uniformly.

FIG. 8 is a diagram illustrating an embodiment without the side ribs 27, wherein a rift in the flow of the diluent liquid is formed and extended to bias the flow toward a certain area of the side of the head. FIG. 9 is a diagram, wherein the side ribs 27 allow the diluent liquid to uniformly flow all over the side of the head 1.

According to the invention, since the respective jet nozzles for different concentrated liquids protrude from the lower face of the head and the tip face of each nozzle is inclined, almost all the remaining concentrated liquid adhering to the lower face of the nozzle drops before a different concentrated liquid is selected and supplied to thereby prevent the concentrated liquid from mixing into a subsequently selected concentrated liquid.

Furthermore, the protruding rib installed on the lower face of the head prevents the diluent liquid from flowing beneath the lower face of the head.

Since the diluent liquid passage is supplied with a carbon dioxide gas through the safety valve after the drink is served and the gas blows the remaining liquid away from the head and the nozzles, there is no liquid remaining in the diluent liquid passage or the nozzle. The inside of the distributor is thus kept clean. The dripped concentrated liquids and diluent liquids are stored in a Waste-liquid receiver (not shown), and discharged for cleaning when the concentrates are replenished.

What is claimed is:

1. A mixing type drink distributor comprising, a head having a plurality of jet pipes for supplying different concentrated liquids and a supply part for supplying a diluent liquid to dilute the concentrated liquids, a nozzle installed around an outer circumference of the head and having a mixing section for mixing one of the concentrated liquids with the diluent liquid and an opening section situated under the mixing section for ejecting the mixture in the mixing section downwardly, and jet nozzles fixed to the jet pipes to protrude from a lower face of the head, each jet nozzle having an inclined tip end, a lowest part of the inclined tip end being located near a center of the head so that the concentrated liquids are ejected through the respective jet nozzles without contacting the head.

2. A mixing type drink distributor according to claim 1, wherein the jet nozzles are located on a circle, and a diameter of a circle circumscribing outer portions of pores of the nozzles is smaller than an inner diameter of an opening of the opening section.

3. A mixing type drink distributor according to claim 3, wherein said head has a rib protruding downwardly from a lower outer portion thereof so that the diluent liquid does not flow beneath the lower face of the head.

4. A mixing type drink distributor according to claim 3, wherein the head has a plurality of protruding side ribs, each rib extending from a portion where the diluent liquid changes its direction onto a side of the head to a middle of the side without extending to a bottom of the head.

5. A mixing type drink distributor according to claim 4, further comprising a passage connected to the supply port, and a carbon-dioxide passage connected to the passage for supplying a carbon-dioxide gas to the supply port.

6. A mixing type drink distributor according to claim 1, further comprising a passage connected to the supply port for the diluent liquid, a carbon-dioxide passage connected to the passage for the diluent liquid for supplying a carbon-dioxide gas to the supply port, and means for supplying the carbon-dioxide gas situated at the carbon-dioxide passage, said supplying means being actuated after each drink is served so that the carbon dioxide gas blows away a residual liquid in the passage and head.

7. A mixing type drink distributor according to claim 6, wherein a safety valve is connected to the carbon-dioxide passage.

8. A mixing type drink distributor according to claim 1, further comprising a rib protruding downwardly from a lower outer portion of the head.

9. A mixing type drink distributor comprising, a head having a side wall, a plurality of jet pipes for supplying different concentrated liquids and a supply port located above the side wall for supplying a diluent liquid to dilute the concentrated liquids, a nozzle installed around an outer circumference of the head and having a mixing section for mixing one of the concentrated liquids with the diluent liquid and an opening section situated under the mixing section for ejecting the mixture in the mixing section downwardly, and a plurality of protruding side ribs formed on the side wall of the head to be equally spaced apart from each other, each rib having an upwardly projected curved upper portion, a flat lower portion, two lateral sides between the upper portion and the lower portion and an outer surface extending generally along the side wall of the head and spaced from an inner surface of the nozzle, each rib extending from an upper end of the side wall, where the diluent liquid changes its direction onto the side wall of the head, to a middle of the side wall without extending to a bottom of the side wall of the head.

* * * * *

UNITED STATES PATENT AND TRADEMARK OFFICE

CERTIFICATE OF CORRECTION

PATENT NO. : 5,649,644

DATED : July 22, 1997

INVENTOR(S) : Masami Hashimoto, Manabu Tachibana

It is certified that error appears in the above-indentified patent and that said Letters Patent is hereby corrected as shown below:

In column 2, line 64, change "check" to --solenoid--;
In column 3, line 17, delete "f" after semicolon;
line 37, after "art;" add --and--;
line 45, change "FIG. 2 is section" to --FIG. 2 is a section--; and
In column 5, line 58, change "claim 3" to --claim 2--.
In the drawings, Fig. 3, change "22 CHECK VALVE" to --22 SOLENOID VALVE-- and mark "◁" to --O--.

Signed and Sealed this

Thirteenth Day of January, 1998

Bruce Lehman

*Attest:*

BRUCE LEHMAN

*Attesting Officer*

*Commissioner of Patents and Trademarks*